United States Patent [19]

Redmon et al.

[11] Patent Number: 4,960,965

[45] Date of Patent: Oct. 2, 1990

[54] COAXIAL CABLE WITH COMPOSITE OUTER CONDUCTOR

[76] Inventors: Daniel W. Redmon, 1215 Riverside Dr., Lompoc, Calif. 93436; David K. Brown, 3700 S. Sepulveda Blvd. #304, Los Angeles, Calif. 90034

[21] Appl. No.: 272,784

[22] Filed: Nov. 18, 1988

[51] Int. Cl.[5] ..... H01B 7/34

[52] U.S. Cl. ..... 174/102 R; 174/36; 174/102 SC

[58] Field of Search ..... 174/102 R, 102 SC, 108, 174/109, 36; 338/214

[56] References Cited

U.S. PATENT DOCUMENTS

| | | | |
|---|---|---|---|
| 1,987,508 | 1/1935 | Johns et al. | 174/102 SC |
| 2,754,350 | 7/1956 | Hurd | 174/102 R |
| 3,219,029 | 11/1965 | Richards et al. | 174/36 |
| 3,594,491 | 7/1971 | Zeidlhack | 174/36 |
| 4,301,428 | 11/1981 | Mayer | 333/12 |
| 4,317,001 | 2/1982 | Silver et al. | 174/102 SC |
| 4,408,089 | 10/1983 | Nixon | 174/36 X |
| 4,486,252 | 12/1984 | Lloyd | 174/36 X |
| 4,486,721 | 12/1984 | Cornelius et al. | 331/1 |
| 4,518,632 | 5/1985 | Jones | 427/118 |
| 4,600,642 | 7/1986 | Lodge et al. | 428/367 |
| 4,609,586 | 9/1986 | Jensen et al. | 428/209 |
| 4,644,092 | 2/1987 | Gentry | 174/36 |
| 4,684,762 | 8/1987 | Gladfelter | 174/36 |
| 4,687,882 | 8/1987 | Stone et al. | 174/102 SC |
| 4,689,601 | 8/1987 | Coffey et al. | 338/214 |
| 4,694,122 | 9/1987 | Visser | 174/109 X |
| 4,700,171 | 10/1987 | Coffey et al. | 338/214 |
| 4,822,950 | 4/1989 | Schmitt | 174/109 X |

FOREIGN PATENT DOCUMENTS

| | | | |
|---|---|---|---|
| 3402763 | 8/1985 | Fed. Rep. of Germany | 174/109 |

*Primary Examiner*—Morris H. Nimmo

*Attorney, Agent, or Firm*—Harvey S. Hertz; William T. O'Neil

[57] ABSTRACT

A coaxial cable structure for electrical signal transmission at frequencies up to the microwave region. The center conductor may be a conventional metallic conductor and the dielectric material between the center conductor and the outer coaxial shield conductor and the outer coaxial shield conductor may be conventional polyethylene or polytetrafluoroethylene. The outer conductor is formed over the dielectric layer acting as a mandrel by means of emplaced, small diameter carbon fibers stabilized in place by an impregnating resin. Use of a curable resin forms the cable rigidly. A variation employs braided carbon fibers without curable resin.

10 Claims, 1 Drawing Sheet

COAXIAL CABLE WITH COMPOSITE OUTER CONDUCTOR

BACKGROUND OF THE INVENTION

Coaxial cables are well known and widely used as transmission lines for electrical signals in the video to microwave frequency range. Prior art coaxial cables may be of the rigid or flexible type. Rigid types may have a copper wire center conductor and a solid copper tubing outer conductor. The dielectric may be mostly gas in such arrangements, with only minimal insulating support structure holding the center conductor coaxial within the outer conductor.

A more familiar type of known coaxial cable is at least partially flexible and consists of a metallic solid or stranded wire center conductor surrounded by a solid, but usually not rigid, dielectric material having an outer conductor formed of a flexible, braided wire or metallic mesh layer held in coaxial relationship with the center conductor by the dielectric material.

Aircraft and space vehicles employ many electronic systems which, in turn, require signal interconnections. The signals may be pulses in the video frequency domain or radio frequency and microwave signals relating to the various communication and instrumentation functions required. Microwave signal conveyance is of primary importance.

It has always been important to minimize the weight of any apparatus carried by airborne vehicles and in fact is critical in space vehicles. The structural members of the vehicles themselves can be constructed of composites which provide the required strength but are lighter overall than the traditional materials of aircraft construction. The incentive for reduced vehicle weight is obvious in terms of overall mission performance, reduced operating costs and increased "payload" capability.

The technology associated with coaxial cables has not advanced apace with other advances in the aircraft/spacecraft technology. Such high density metals as copper, stainless steel and silver have continued to be used in coaxial cable fabrication. The common standard for microwave signal conveyance (RG-402) consists of a silver and copper clad stainless steel center conductor, a coaxial dielectric layer of polyethylene or polytetrafluoroethylene commonly known as "Teflon" (a Dupont trademark), and a solid copper tube outer conductor. That construction provides a rigid transmission line, formable to fit irregular spaces. The flexibility of coaxial cables of the shield braid outer conductor type is often not required and may even be detrimental in aircraft and space vehicles subject to vibration in their operational environments.

In the aforementioned solid, copper tube, outer coaxial conductor prior art configuration, the weight of the outer conductor is over half of the total weight of the cable.

It may be said to have been the general object of this invention to provide a coaxial cable structure of reduced weight, but with electrical performance comparable with prior art coaxial cables.

The so-called composite materials employing carbon (graphite) fibers have been employed as structural members where high strength-to-weight ratios are required. The electrically conductive properties of such fibers have also received prior art attention in various applications.

U.S. Pat. No. 4,687,882 discloses the loading of insulation material with conductive carbon fibers in a surge attenuating electrical cable.

U.S. Pat. No. 4,518,632 describes an undersea cable in which an inner conductor is formed of conductive fibers in a composite-like structure having good conductivity and tensile strength. Intercalation of graphite fibers is also indicated, this process enhancing conductivity.

The manner in which the invention employs the characteristics of carbon (graphite) fiber composites in a coaxial cable to reduce weight while providing comparable electrical performance vis-a-vis the prior art for such cables will be understood as this specification proceeds.

SUMMARY OF THE INVENTION

According to the invention, a coaxial cable of unique construction and nearly 50% lighter than prior art cables is provided. The weight reduction is achieved through use of a carbon-fiber/polymer composite as the cable outer conductor. Such an outer layer has a density approximately one-sixth that of copper.

Since so much of the prior art cable weight is in the outer conductor, and comparatively little is in the center conductor, there is little incentive for reducing the center conductor contribution to cable weight. Accordingly, the cable construction of the invention may employ a conventional metallic center conductor and a conventional dielectric layer. The composite outer layer according to the invention is applied over the dielectric layer, the latter serving as a mandrel.

The center conductor may be of solid metal or may be stranded. However, solid metal is preferred, particularly for microwave signal transmission. The cross-sectional area of the center conductor is small compared to that of the outer conductor and it, therefore, represents a minimal contribution to overall cable weight.

The carbon fibers (filaments) employed are of relatively low resistivity and are applied generally parallel to the cable axis although the fibers may alternatively be braided or spiralled about the dielectric layer periphery. An impregnation of the fibers in place with a thermosetting resin (epoxy resin, for example) provides a curable matrix holding the fibers in place and causing the assembled carbon filaments to function as a solid conductive layer. This is true because signal wavelengths are several orders of magnitude greater than the one-to-three micron lateral fiber spacing. This small spacing between fibers allows current to pass through the fiber and resin combination in a manner comparable to that effected in a solid metallic outer shell.

Detailed information for typical cable construction according to the invention is provided hereinafter.

BRIEF DESCRIPTIONS OF THE DRAWINGS

DETAILED DESCRIPTION

Figure 1:
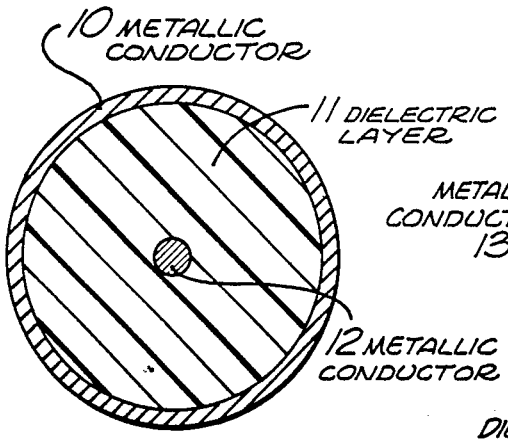
FIG. 1 PRIOR ART
FIG. 1 is a cross-section of a typical prior art solid metal outer conductor coaxial lines.

Referring now to FIG. 1, the prior art configuration shown includes a coaxial cable having a solid circular cross section, metallic outer conductor 10, a metallic center conductor 12 and a dielectric layer holding the center conductor at the axis of the cylindrical shell 10 as hereinbefore mentioned in the background discussion.

Figure 2:
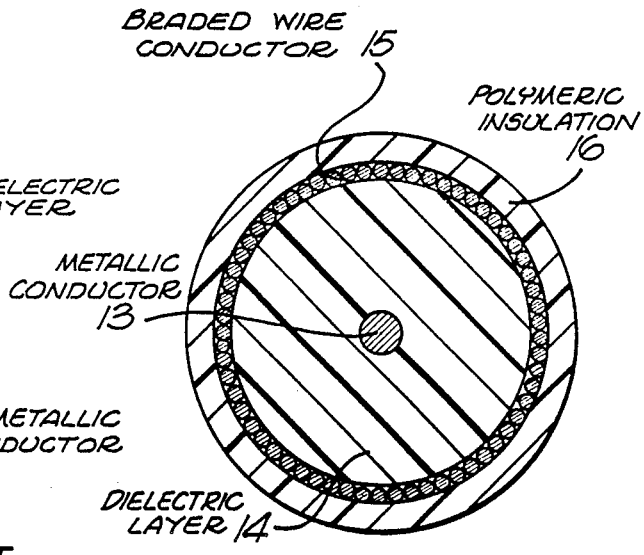
FIG. 2 PRIOR ART
FIG. 2 is a cross-section of a typical prior art flexible coaxial cable.

FIG. 2 is likewise prior art, showing a common form of flexible coaxial cable having center conductor 13, dielectric layer 14 of polytetrafluoroethylene (PTFE), for example, and a braided wire outer conductor 15. This braided outer conductor together with the solid, but not rigid, dielectric layer affords a degree of flexibility. A polymeric insulation protection layer 16 is applied as an overall jacket.

Figure 3:
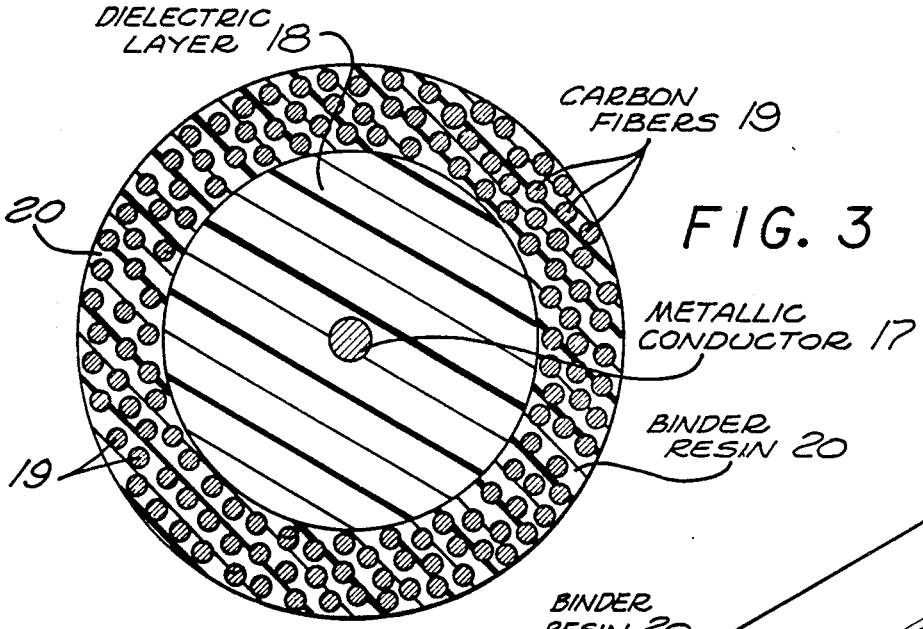
FIG. 3 is a cross-section of a coaxial cable taken as indicated on FIG. 4 according to the invention.
Figure 4:
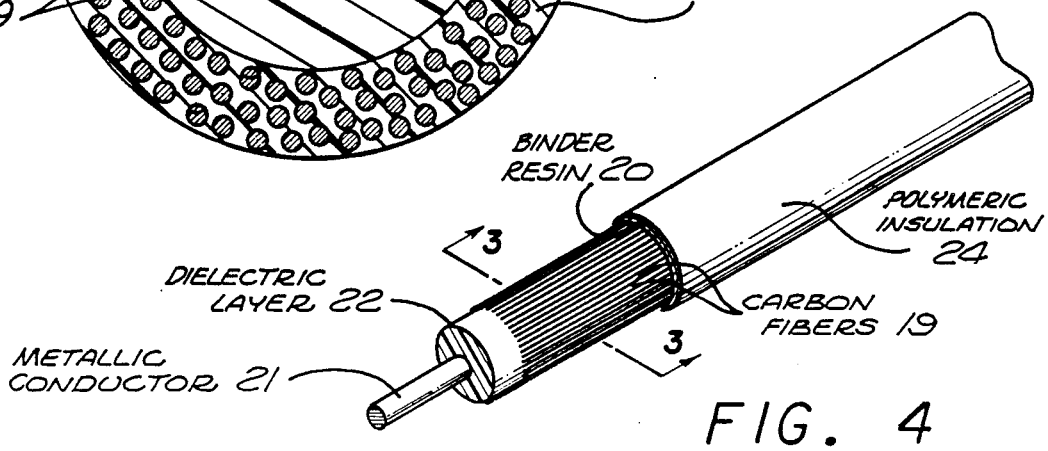
FIG. 4 is a cut-away pictorial of a coaxial cable employing carbon filaments in the outer conductor (shield) for flexibility.

FIG. 3 depicts a rigid or semi-rigid form of coaxial cable according to the invention, in cross-section taken as indicated on FIG. 4. FIG. 4 shows the parallel filaments pictorially In FIG. 3, and FIG. 4, a solid center conductor 17 is preferred, and if a metal of resistance significantly higher than copper is used (stainless steel for example) for the center conductor, application of a coating (plating) of copper or silver is advantageous.

The dielectric layer 18 has an outer perimeter which is concentric with respect to inner conductor 17. The dielectric 18 may be a material such as polyethylene or polytetrafluoroethylene, the latter being preferred because of its resistance to the temperatures encountered in curing the binder resin 20 and because of its superior dielectric properties.

The lay-up of carbon fibers 19 comprises a layer of at least 0.005 inches thickness. The individual fibers are less than 20 microns in diameter and have a density between 1.65 g/cc and 2.25 g/cc. A fiber diameter of 12 microns was selected for a laboratory prototype section of coaxial cable for experimental confirmation of characteristics. Fiber diameters are necessarily exaggerated for illustration in FIG. 3 and FIG. 4. In the fiber lay-up 19, the fibers comprise approximately 70% of the volume of the lay-up achieved by close lateral fiber spacing on the order of one to three microns. The remaining volume of the lay-up comprises mostly a cured resin impregnant 20 as contemplated in FIG. 3, thereby locking the fibers in place and forming a solidified outer coaxial conductor. The binder resin may be any of the common resins including epoxies, polyimides, polyesters or vinylestors which, when cured produce a solid shell outer conductor. Any forming desired can be accomplished prior to curing. The small spacing and small diameter of the carbon fibers (filaments) cause them to function as a solid conductive shell for signals carried in cables according to the invention since the wavelengths of signals applied will be several orders of magnitude large than the fiber diameter and spacing. The small lateral spacing of fibers allows current to pass through the resin between fibers, and the quality of shielding afforded by the outer conductor composite is much superior to that provided by braided wire prior art forms.

The term carbon is to be understood to include graphite and alotropic (turbostatic) forms thereof.

In FIG. 4, the invention is depicted in partially cutaway pictorial form. The center conductor 21 and dielectric layer 22 are as previously described. An outer polymeric jacket 24 is shown applied over fiber lay-up 19 for protection and electrical isolation of the outer conductor. Such an outer jacket may be applied to the configuration of FIG. 3 as it has been at 16 in FIG. 2 (prior art). However, the rigid embodiment of FIG. 3 and FIG. 4 has less need for such a jacket for protection.

For experimental confirmation of the concepts of the invention, tests were performed on three difference experimental sections of line identified as cables 1, 2 and 3 in Table I following:

TABLE I

| Laboratory Test Results For Experimental Cable | | | | | | |
|---|---|---|---|---|---|---|
| | | | | Attenuation per lineal feet | | |
| Fiber Used | Fiber Resisitvity | Dielectric Layer | Measured Characteristic Impedance | @ 750 MHz | @ 1.5 GHz | @ 2.23 GHz |
| P-100 (Amoco Performance Products Div.) | $0.25 \times 10^{-3}$ | PTFE* | 54 ohms | 0.30 dB | 0.5 dB | 0.5 dB |
| F3 (0) (Fortafil Carbon Fiber Div. of AK20 Corp.) | $1.67 \times 10^{-3}$ | PTFE* | 5.45 ohms | 0.55 dB | 0.75 dB | 0.90 dB |
| F3 (0) (Fortafil Carbon Fiber Div. of AK20 Corp.) | $1.67 \times 10^{-3}$ | PE** | 68 ohms | 0.90 dB | 1.2 dB | 1.30 dB |
| RG402 (prior art copper shell) | — | PTFE* | 52 ohms | 0.05 dB | 0.2 dB | 0.25 dB |

*Polytetrafluoroethylene
**Polyethylene

Although the signal attenuations encountered in coaxial lines according to the invention exceed that of the prior art reference RG402, the experimental results show the utility of the novel combination and permit predictions of reduced attenuation by improving the conductivity of the carbon fibers. The experimental results were obtained without any effort to reduce the fiber resistivity although it is known that baking or intercalation or both will produce such resistivity reductions. From Table I, the effect of lower fiber resistivity in lowering cable attenuation is evident. Quality of dielectric is, of course, a known parameter relating to attenuation at highest frequencies.

In air or space vehicles the lengths of coaxial cable employed may be relatively short, reducing the criticality of attenuation as a cable parameter.

The close carbon filament lateral spacing, being on the order of one to three microns, permits current passage laterally among the filaments as well as axially through them. Thus the entire composite forms a conductor. The fiber (carbon filament) content in the composite outer layer (FIG. 3) is approximately 70%, the other 30% being the impregnating polymer (resin). The low density of the carbon fibers (2.15 grams per cubic centimeter, maximum) compares to 8.96 for copper and 9.9 for stainless steel. Replacing the outer coaxial cable conductive layer with the carbon fiber composite described reduces the overall weight of a typical cable by nearly 50%.

The fibers of the FIG. 3 configuration are laid generally parallel to the axis of the cable, however, a braided or spiralled lay-up is possible even in the rigid embodiment of FIG. 3.

Intercalation for carbon fiber resistivity reduction can be effected by halogen doping, as by baking in a halogen (iodine) atmosphere. That process is known and has been employed in connection with other unrelated combinations where it is desired to reduce carbon particle resistivity.

Various modifications within the scope of the inventive concepts will suggest themselves to those of skill in this art once the nature and advantages of the invention have been fully appreciated. Accordingly, it is not intended that the scope of the invention should be considered limited by the drawings or this description, these being typical and illustrative only.

We claim:

1. A coaxial cable especially for electric signal transmission in the video to microwave frequency range, said cable having an inner conductor of circular cross-section and a solid dielectic layer over said inner conductor, said dielectric layer having a perimeter surface of generally circular cross-section generally concentric with respect to said inner conductor, comprising:

an outer conductive shield formed by deposition of plural layers of elongated carbon filaments along said dielectric perimeter in lateral juxtaposition and extending generally parallel to said inner conductor; and a curable resin impregnating said carbon filament layers to produce a rigid composite outer conductor for said cable.

2. A rigid coaxial cable comprising:

a center conductor of generally circular cross-section;

a dielectric material surrounding said center conductor, said dielectric material extending substantially over the full length of said cable and having a perimeter surface substantially concentric with said center conductor;

a conductive shield comprising a plurality of elongated carbon filaments in a plurality of layers emplaced along said dielectric material perimeter and extending generally mutually parallel;

and a curable polymeric resin embedding said carbon filament layers to form said rigid cable.

3. The combination according to claim 1 in which said carbon filaments have diameters less than 20 microns and density between 1.65 and 2.25 grams per cubic centimeter.

4. A coaxial cable according to claim 2 in which said carbon filaments have diameters less than 20 microns and densities greater than 1.65 but less than 2.25 grams per cubic centimeter and are emplaced in lateral contact in each of said layers.

5. The combination according to claim 3 in which said carbon filaments are intercolated for electrical resistance reduction.

6. The combination according to claim 4 in which said carbon filaments are intercolated for electrical resistance reduction.

7. The combination according to claim 3 in which said carbon filaments are in heat treated form for electrical resistance reduction.

8. The combination according to claim 4 in which said carbon filaments are in heat treated form for electrical resistance reduction.

9. The combination according to claim 3 in which said plural layers of carbon fibers form a shield of at least 0.005 inches thickness.

10. The combination according to claim 9 in which said carbon fibers of said layers are emplaced with lateral spacing not exceeding three microns and said plural layers of carbon fibers form a shield having not less than 70 percent of its volume comprised of said carbon fibers.

* * * * *